US007119037B2

(12) United States Patent
Hexels

(10) Patent No.: US 7,119,037 B2
(45) Date of Patent: Oct. 10, 2006

(54) CAMOUFLAGE NET

(75) Inventor: Gerd Hexels, Nettetal (DE)

(73) Assignee: Texplorer GmbH, Nettetel (DE)

( * ) Notice: Subject to any disclaimer, the term of this patent is extended or adjusted under 35 U.S.C. 154(b) by 0 days.

(21) Appl. No.: 10/219,217

(22) Filed: Aug. 14, 2002

(65) Prior Publication Data

US 2003/0044575 A1 Mar. 6, 2003

(30) Foreign Application Priority Data

Sep. 5, 2001 (DE) ..... 101 43 382

(51) Int. Cl.

| | |
|---|---|
| ***D04B 1/22*** | (2006.01) |
| ***D04B 1/10*** | (2006.01) |
| ***D04B 21/00*** | (2006.01) |
| ***B32B 5/02*** | (2006.01) |
| ***B32B 5/10*** | (2006.01) |

(52) U.S. Cl. ..... 442/312; 442/313; 442/131; 428/134; 428/135; 428/144; 428/147; 66/169 R; 2/900; 135/87

(58) Field of Classification Search ..... 442/304, 442/312, 313, 317, 308, 59, 131; 428/134, 428/135, 103, 144, 147; 66/169 R; 2/900; 135/87

See application file for complete search history.

(56) References Cited

U.S. PATENT DOCUMENTS

| | | | | |
|---|---|---|---|---|
| 2,362,786 | A | 11/1944 | Williams | |
| 4,064,305 | A | 12/1977 | Wallin | 428/246 |
| 4,493,863 | A | 1/1985 | Karlsson | |
| 5,348,789 | A | 9/1994 | Hellwig | |

FOREIGN PATENT DOCUMENTS

| | | | |
|---|---|---|---|
| DE | 26 20 093 | | 11/1976 |
| DE | 3117245 | A1 | 11/1982 |
| DE | 3810121 | * | 10/1989 |
| DE | 3810121 | A1 | 10/1989 |
| DE | 4023287 | A1 | 1/1992 |
| DE | 29716362.0 | | 1/1998 |
| GB | 860282 | | 2/1961 |
| GB | 1 314 624 | | 4/1973 |

* cited by examiner

*Primary Examiner*—Terrel Morris
*Assistant Examiner*—Lynda Salvatore
(74) *Attorney, Agent, or Firm*—Davis & Bujold, P.L.L.C.

(57) ABSTRACT

A camouflage net, in particular for covering persons and articles in the desert against detection in a thermal image, has a knitted fabric with a hole structure. The knitted fabric in this case has condensed and/or sealed-off regions.

20 Claims, 2 Drawing Sheets

CAMOUFLAGE NET

FIELD OF THE INVENTION

The invention relates to a camouflage net, in particular for covering persons and articles in the desert against detection in a thermal image and by radar, with a knitted fabric having a hole structure.

BACKGROUND OF THE INVENTION

A generic camouflage net is known from DE 40 23 287 C2.

Camouflage nets of this type serve for the camouflaging of buildings and of fixed and mobile military equipment, such as, for example, motor vehicles, tanks and the like. Camouflage nets of this type are intended to make it possible to camouflage against infrared cameras or thermal-image detectors and against radar contacts. The camouflaging is therefore to be afforded in the infrared, thermal-image, millimeter and centimeter radar radiation range.

The generic camouflage net consists of a polyester knitted fabric with a hole structure, the holes having a diameter or a width and/or height of approximately 2 to 3 mm, and the mutual spacing of the holes ranging approximately within the same order of magnitude. Metal fibers are also worked into the knitted fabric, and the knitted fabric is provided on both sides with a polymer layer which contains approximately 30 to 40% by weight of absorber pigments active in a range of 10 to 100 Ghz.

The generic camouflage net constitutes an advantageous, multi-spectrally active, flame-retarding camouflage net which affords protection in the visual and near IR range. Furthermore, the generic camouflage net has good damping values over a broad spectrum of the microwave range and has low emission in the thermal-image range.

Moreover, the camouflage net offers good mechanical strength and flexibility over a wide temperature range.

In comparison with other camouflage nets known from the prior art, for example from DE 38 10 121 A1 and DE 31 17 245 A1, the camouflage net known from the publication forming the preamble has improved camouflaging properties.

In all the camouflage nets known from practice, there is a problem, when they are used in desert regions, that the camouflage nets, which are based on the principle of convection, are too cold by day and too warm at night when used in the desert. The sand, rocks and vegetation heat up to an extreme extent in the desert throughout the day due to the sun. The region which is covered by the camouflage nets is shaded by the camouflage nets and thus becomes colder since the covered ground surface cannot heat up to the same extent. A signature which differs from the surroundings therefore appears in the thermal infrared range.

The situation at night with regard to the signature which is different in the thermal infrared range is not as extreme as during the day, but, here too, improvement or optimization is necessary.

There has hitherto been no practicable possibility known from the publications mentioned and from practice which makes it possible to match the temperature of the net or of the camouflaged region in desert areas. A further problem, in this case, is that the various desert areas make it necessary for the camouflage nets to meet different requirements with regard to a matching of the temperature.

SUMMARY OF THE INVENTION

The object on which the present invention is based is to eliminate the disadvantages mentioned and to improve camouflage nets for use in desert areas, in such a way that the temperature of the net is adapted to the surroundings in a manner such that, particularly in the thermal infrared range, the camouflage net or the region covered by the camouflage net does not have a signature which differs from the desert surroundings.

This object is achieved, according to the invention, in that the knitted fabric has condensed and/or sealed-off regions.

The inventor recognized, in a way which is not obvious, that the temperature differences between the camouflage net or the region covered by the camouflage net and the surroundings result primarily from the fact that the covered ground surface cannot heat up to the same extent as the surroundings and the air circulation cools the camouflage net. Convection is partially reduced by means of the regions of the knitted fabric which are condensed and/or sealed off according to the invention. By virtue of this technology, on the one hand, the passage of air is reduced and, on the other hand, the surface is increased, in order partially to allow solar warming. The condensed or sealed-off regions warm up to a greater extent than the non-condensed regions. The net thus has a thermal camouflage signature.

The hitherto known disadvantages of the prior art are eliminated in an advantageous and simple way by means of the condensed and/or sealed-off regions. The camouflage net behaves in a similar way to the desert surroundings owing to the reduced air circulation and the condensed and/or sealed-off regions warmed up to a greater extent, so that a similar or identical signature appears in the thermal infrared range.

At night, too, optimization can be achieved by means of the regions condensed and/or sealed off according to the invention. The closed regions or surfaces thus serve as a reflector which in this case reflects the cold night sky. This is advantageous since, in the desert, the sand also does not cool rapidly and likewise acts as a reflector of the cold sky.

As tests have shown, the camouflage net acts in a similar way to the surroundings or the vegetation both by day and at night.

An advantage of the structure as a whole is also that it can be utilized on both sides and has the same effect on both sides.

It is advantageous if the condensed regions of the knitted fabric are produced as Jacquard patterns.

As tests have shown, a particularly good limitation of the airflow can be achieved by means of a kind of Jacquard pattern. The Jacquard patterns can in this case be produced in a simple way and can condense the knits in this region. As tests have shown, the variation in the net structure brought about by the Jacquard pattern is appreciably more suitable for achieving the desired purpose than the likewise possible application according to the invention of a sealing-off film or the like.

The Jacquard pattern may, if appropriate, have different shapes and sizes, depending on requirements or on the particular desert area. The frequency and arrangement of the Jacquard patterns may also be varied correspondingly.

In one form of construction of the invention, furthermore, there may be provision for the condensed and/or sealed-off regions to be arranged irregularly and to cover less then 20% of the entire surface of the knitted fabric.

As has been shown, a surface arrangement of the condensed and/or sealed-off regions of less than 20% is sufficient to adapt the camouflage net or the regions covered thereby to the ambient temperature. The condensed and/or sealed-off regions may be distributed on the camouflage net in terms of their size and their arrangement, in such a way that an airflow passing through the knitted fabric is reduced to the desired extent. The various types of desert may, if appropriate, also have some bearing on this.

As a result of the irregular arrangement and the various shapes of the Jacquard pattern, an irregular surface structure is obtained and a thermal signature corresponding to the surroundings is thus achieved. Irregular arrangements have in this context proved particularly suitable and inconspicuous with regard to the thermal infrared range. A regular arrangement would be unnatural, would consequently be more conspicuous and would therefore be contrasted with the surroundings. The reduction in the airflow for the purpose of increasing solar warming at partial locations and the fact that these are not arranged recurrently or uniformly, but irregularly, lead to an optimum adaption of the camouflage net to the surroundings.

In a development of the invention, there may be provision, furthermore, for the hole structure to be provided with weft insertions in order to increase the stability of the knitted fabric.

As tests have shown, the knitted fabric and therefore the camouflage net acquire very high dimensional stability due to the weft insertions. The handling of the camouflage net both in use and for transport purposes is markedly improved. The weft insertions may in this case take the form of thicker threads in comparison with the remaining knit.

It is advantageous if the knitted fabric is formed from polyester and the holes of the hole structure have a diameter or a width and/or height of approximately 2 to 4 mm, preferably 3 mm×2.7 mm.

Forming the knitted fabric from polyester has proved particularly suitable in terms of simple production and for the intended use.

The diameters of the holes of the hole structure ensure an optimum exchange of the heat flow, so that the thermal image is also ideal and the object to be camouflaged can virtually no longer be distinguished from the surroundings. The specified hole structure allows an advantageous air and heat flow, that is not so open that a warmer object located behind it becomes visible in the thermal image.

In one form of construction of the invention, there may be provision, furthermore, for the holes of the hole structure to be of at least approximately diamond-shaped design and to be arranged in row form in the knitted fabric, the holes being arranged so as to be offset to one another in successive rows.

The holes may, of course, have any desired shape, but, in practice, orifices with an at least approximately diamond shape have proved the most suitable, in practice, for the intended use. Owing to the diamond shape, a corresponding reinforcement of the knitted fabric and consequently of the camouflage net according to the invention is achieved, with the result that high tearing strength values and tear propagation strength values are obtained.

It became clear, in tests, that particularly good results are achieved when the fibers of the knitted fabric are knitted more densely around the holes or when the spacings between the rows of holes are knitted more loosely.

BRIEF DESCRIPTION OF THE DRAWINGS

Advantageous refinements and developments of the invention may be gathered from the further subclaims and from the exemplary embodiment illustrated in principle below with reference to the drawing in which:

DETAILED DESCRIPTION OF THE INVENTION

Camouflage nets for various intended uses are known in principle, for example from DE 40 23 287 C2, so that only the features essential for the invention are dealt with in more detail below.

Figure 1:
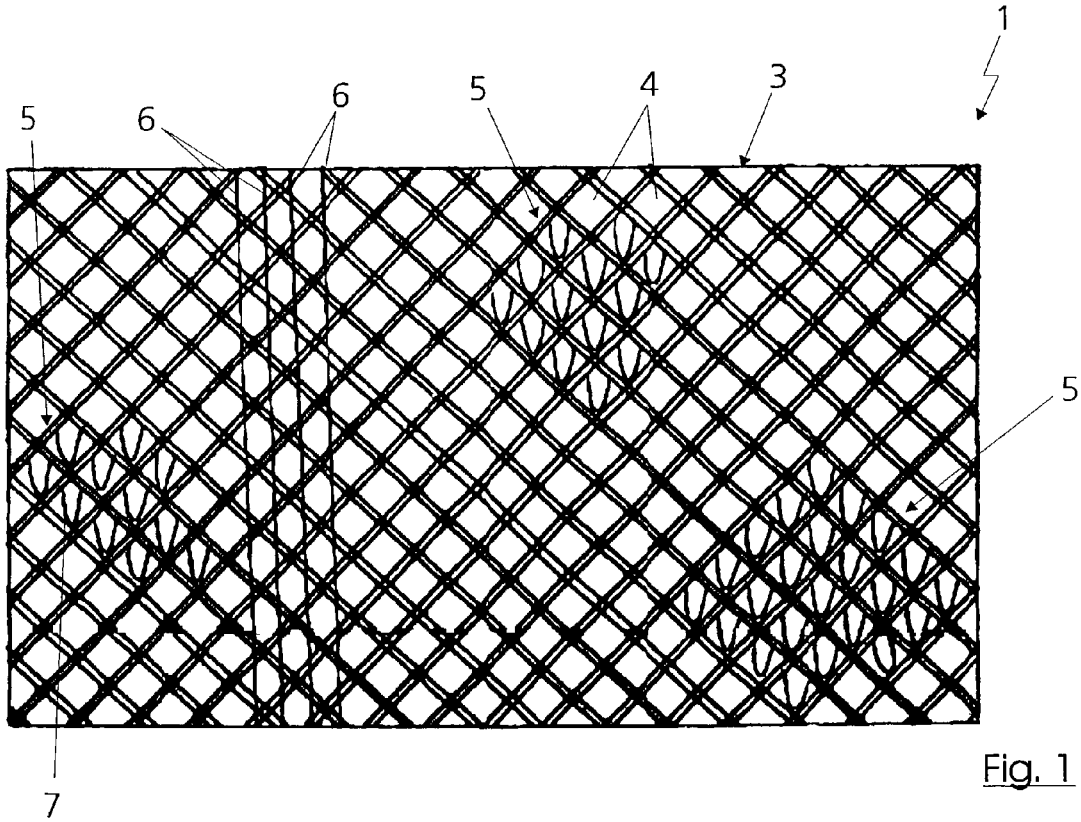
FIG. 1 shows a diagrammatic illustration of a detail of the knitted fabric.

FIG. 1 shows merely diagrammatically, since it is basically known, a knitted fabric 1 which in the exemplary embodiment is formed from polyester. The knitted fabric 1 serves in this case in the usual way as a carrier material for the camouflage net 2 illustrated in more detail in FIG. 2. For this purpose, the knitted fabric 1 is subjected to various known treatment steps as a function of the camouflage net 2 obtained as the end product, such as, for example, flame protection, radar compound and colorings with IRR values. Advantageous treatment steps for this purpose may be gathered, for example, from DE 40 23 287 C2 and DE 26 20 093 A1.

As is evident from FIG. 1, the knitted fabric 1 has a hole structure 3 with holes 4. The holes 4 may be of diamond-shaped design (not illustrated) and have a diameter or a width and height of 3 mm+/−0.3×2.7 mm+/−0.5 mm. The hole structure 3 is of checkerboard-like design, the holes 4 of the hole structure 3 being arranged in row form in the knitted fabric 1. In this case, successive rows of the holes 4 are arranged so as to be offset to one another. With regard to the structural set-up, there may be provision for eight holes 4 to correspond in length and width in each case to 5 cm.

As is likewise evident from FIG. 1, the knitted fabric 1 has condensed and/or sealed-off regions 5. In the exemplary embodiment illustrated, these regions are produced as condensed regions in the form of Jacquard patterns 5. Since these are basically known, a detailed illustration has been dispensed with for the sake of clarity. The Jacquard patterns 5 are arranged in such a way that an airflow passing through the knitted fabric 1 is reduced in such a way that the camouflage net 2 or the surfaces, vehicles, articles or living things covered thereby correspond to the ambient temperature. A thermal camouflage signature is achieved due to the specific use of the Jacquard patterns 4 on the knitted fabric 1.

Producing the condensed and/or sealed-off regions as Jacquard patterns 5 has proved particularly suitable, since the industrial character of the camouflage net 2 is maintained and no problems arise when the camouflage net 2 is folded up or spread out. The camouflage net 2 produced with the Jacquard pattern 5 can therefore be handled just as simply as conventionally known camouflage nets.

As is likewise evident from FIG. 1, the Jacquard patterns 5 are arranged irregularly and have various sizes and shapes. The flexible configuration makes it possible in this case to have appropriate adaption or modification according to the different desert areas.

A use of the Jacquard patterns 5 such that less than 20% of the entire knitted fabric 1 is covered has proved sufficient. To increase the stability of the knitted fabric 1, weft insertions 6, for example in the form of thicker threads, may be provided. In this case, it is advantageous if the entire knitted fabric 1 is provided uniformly with the weft insertions 6. For the sake of clarity, however, only four weft insertions 6 are illustrated in FIG. 1. The knitted fabric 1 has a high load-bearing capacity owing to the weft insertions 6, so that it is possible to use the camouflage net 2 even under high collapsing stresses, without a break in the carrier textile having to be feared. This material may, of course, also be produced without a weft insertion.

A suitable known production method may be gathered from DE 297 16 362 U1.

Simple and advantageous production of the knitted fabric 1 may be carried out by means of a Jacquard Raschel machine or a curtain Jacquard Raschel machine with, for example, a fineness 18 E. To make Jacquard patterns 5, various conventional guide possibilities (for example, thick-point relief effect, thin point or sorting) are known, and therefore these are not dealt with in any more detail below. The basis for these may be, for example, a known tricot weave. In tricot weaves, the stitches are guided alternately on two adjacent needles. A connection between adjacent wales is thereby made, so that a textile sheet-like structure is obtained. The tricot weave may be closed or open-worked. An open tricot weave has proved advantageous in this context. Since these are known methods, they are not described in any more detail.

Introduction of the Jacquard pattern 5 into the knitted fabric 1 may be carried out via a known creel yarn, not illustrated, which is introduced in a normal guide arrangement by means of a three-needle technique. The Jacquard patterning 5 may take place in any form and differently for each repeat.

The Jacquard patterns 5 may be produced in different densities. In this case, there is provision for the Jacquard patterns 5 to be condensed in such a way that, in the finished state of the camouflage net 2, these regions are closed almost completely.

In an embodiment which is not illustrated, but can be imagined in a simple way, in the knitted fabric 1 a Jacquard thread 7 may lie over three fringe threads in each stitch row.

In another embodiment, there may be provision, in an open variant, for the Jacquard thread 7 to lie over two fringe threads in every second stitch row only.

The condensed and/or sealed-off regions may, of course, be produced in many different ways. Thus, it is also conceivable for spots or portions made of a suitable material to be applied to the knitted fabric or for the knitted fabric 1 to be provided with these. The sealed-off and/or condensed regions which the knitted fabric possesses according to the invention are in this case to be understood as not necessarily having to be connected directly to the knitted fabric 1. It is essential, in this case, that, by means of the sealed-off and/or condensed regions, increased solar warming takes place and air circulation through the knitted fabric 1 or the hole structure 3 is reduced.

Figure 2:
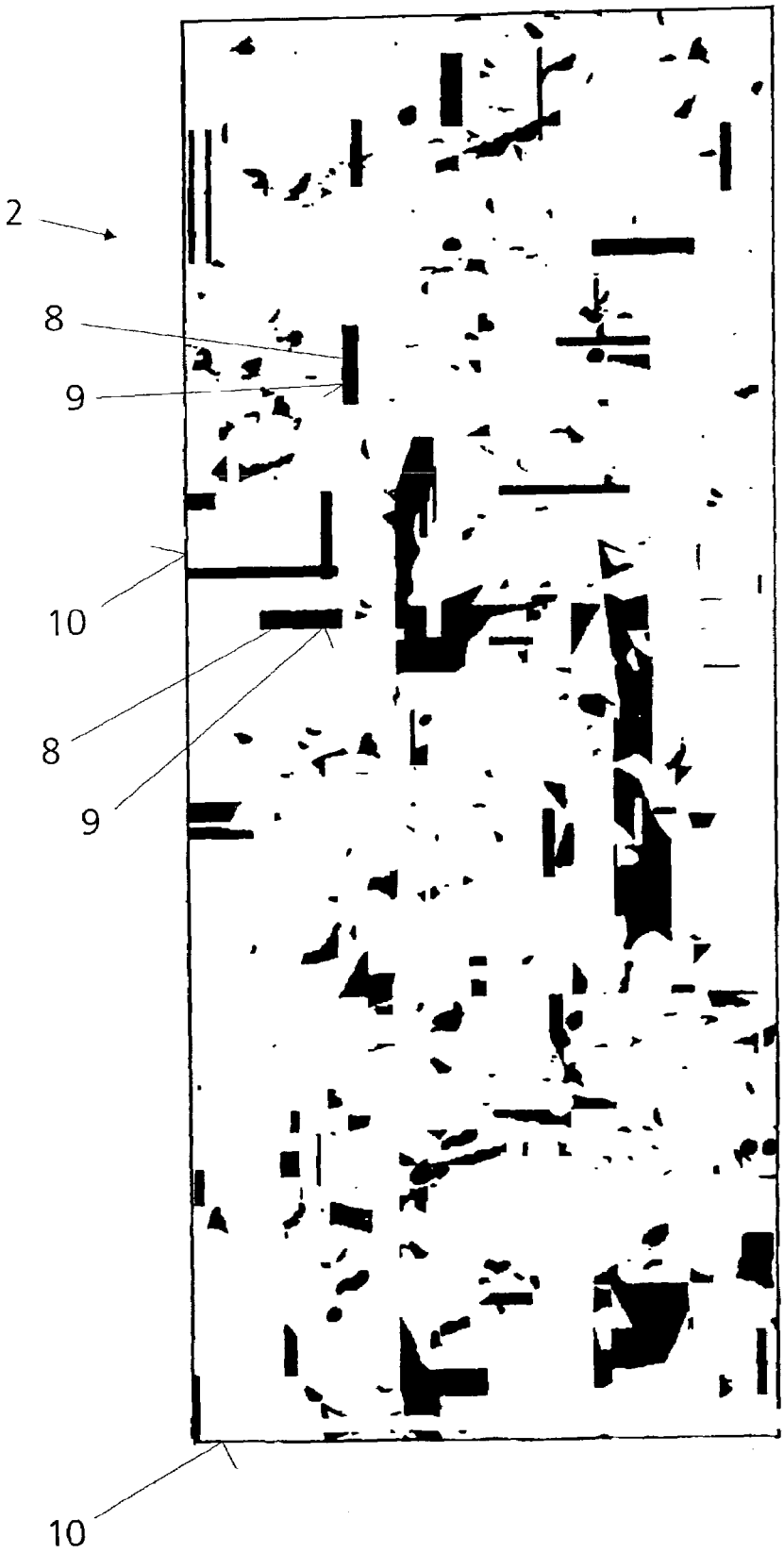
FIG. 2 shows a top view of a fully processed camouflage net with a camouflage pattern.

The web, illustrated in FIG. 2, corresponding to one repeat may have a polymer layer, not illustrated in any more detail, which surrounds the knitted fabric 1 on both sides. The polymer layer may in this case constitute the carrier layer for absorber pigments which serve for the absorption of radar beams in a microwave range of 10 to 100 GHz. With regard to an advantageous fireproof composition of the polymer layer, reference is made in this respect to DE 40 23 287 C2.

Moreover, the camouflage net 2 illustrated in FIG. 2 may be provided with a flame protection layer which surrounds the knitted fabric 1 on all sides, that is to say even in the holes 4. A hydrophobic finish of the camouflage net 2 may likewise be provided.

The camouflage net 2 illustrated in the form of a repeat in FIG. 2 has a camouflage design with printed-on spots 8. A plurality of the spots 8 in this case have side edges 9 which are for a large part composed of at least approximately rectilinear portions. A large number of rectilinear portions are in this case formed at least approximately parallel to the side edges 10 of the camouflage net 2. In order to acquire as ideal a camouflage effect as possible, this number should, if possible, comprise more than half the rectilinear portions. By virtue of a configuration of this type, a simple combination of a plurality of camouflage nets 2 is possible. During assembly, therefore, rectilinear side edges 10 occurring due to the boundary of the camouflage net 2 are inconspicuous or are conspicuous only to a minimal extent, since the net has per se, in any case, a comparatively large number of straight side edges 9, a relatively large proportion of which, in turn, run at least approximately parallel to the side edges 10 of the camouflage net 2.

The invention claimed is:

1. A camouflage suitable for covering at least one of a person and article in a desert against detection via a thermal image, the camouflage comprising a knitted fabric having a hole structure;

wherein the knitted fabric (1) has a plurality of condensed and sealed-off regions (5);

the plurality of condensed and sealed-off regions (5) are arranged irregularly throughout the camouflage;

the plurality of condensed and sealed-off regions (5) have different shapes and different sizes; and the hole structure of the plurality of condensed and sealed-off regions (5) are partially restricted so as to restrict airflow therethrough.

2. The camouflage as claimed in claim 1, wherein the condensed and sealed-off regions of the knitted fabric (1) are produced as Jacquard patterns (5).

3. The camouflage as claimed in claim 1, wherein the plurality of condensed and sealed-off regions (5) are arranged in such a way that a thermal camouflage signature is obtained.

4. The camouflage as claimed in claim 2, wherein a Jacquard thread (7) lies over three fringe threads in each stitch row.

5. The camouflage as claimed in claim 2, wherein a Jacquard thread (7) lies over two fringe threads in every second stitch row.

6. The camouflage as claimed in claim 1, wherein the hole structure (3) is provided with weft insertions (6) in order to increase the stability of the knitted fabric (1).

7. The camouflage as claimed in claim 1, wherein the hole structure (3) is of checkerboard-like design.

8. The camouflage as claimed in claim 1, wherein the knitted fabric (1) is formed from polyester and holes (4) of the hole structure (3) with one dimension between approximately 2 mm to 4 mm.

9. The camouflage as claimed in claim 1, wherein the knitted fabric (1) has first and second sides and is provided with a polymer layer on both of the first and second sides.

10. The camouflage as claimed in claim 1, wherein the knitted fabric (1) is surrounded by a flame protection layer.

11. The camouflage as claimed in claim 1, wherein holes (4) of the hole structure (3) are of at least approximately diamond-shaped design.

12. The camouflage as claimed in claim 1, wherein holes (4) of the hole structure (3) are arranged in row form in the knitted fabric (1), and the holes (4) are arranged so as to be offset to one another in successive stitch rows.

13. The camouflage as claimed in claim 1, wherein the knitted fabric (1) is formed from polyester and holes (4) of the hole structure (3) with one dimension between approximately 3 mm×2.7 mm.

14. A camouflage net suitable for covering at least one of a person and article in a desert against detection by thermal imaging, the camouflage net comprising a knitted fabric having a hole structure therein;

wherein the knitted fabric (1) has a plurality of condensed and sealed-off regions (5);

the plurality of condensed and sealed-off regions (5) are arranged irregularly throughout the camouflage net;

each of the plurality of condensed and sealed-off regions (5) have one of a different shape and a different size from another one of the plurality of condensed and sealed-off regions (5); and the hole structure of the plurality of condensed and sealed-off regions (5) are partially restricted so as to restrict airflow therethrough whereby a thermal camouflage signature is obtained from use of the camouflage net.

15. A camouflage net suitable for covering at least one of a person and article in a desert against detection by thermal imaging, the camouflage net comprising a knitted fabric having a hole structure therein;

wherein the knitted fabric (1) has a plurality of condensed and sealed-off regions (5);

the plurality of condensed and sealed-off regions (5) are arranged irregularly throughout the camouflage net;

each of the plurality of condensed and sealed-off regions (5) have one of a different shape and a different size from another one of the plurality of condensed and sealed-off regions (5);

the hole structure of the plurality of condensed and sealed-off regions (5) are partially restricted so as to restrict airflow therethrough whereby a thermal camouflage signature is obtained from use of the camouflage net;

the knitted fabric (1)is formed from polyester and holes (4) of the hole structure (3) are at least approximately diamond-shaped and have one dimension of approximately 2 mm to 4 mm; and the knitted fabric (1) is surrounded by a flame protection layer.

16. The camouflage net as claimed in claim 15, wherein a Jacquard thread (7) lies over three fringe threads in each stitch row.

17. The camouflage net as claimed in claim 15, wherein a Jacquard thread (7) lies over two fringe threads in every second stitch row.

18. The camouflage net as claimed in claim 15, wherein the hole structure (3) is provided with weft insertions (6) to increase a stability of the knitted fabric (1), and the hole structure (3) is of checkerboard-like design.

19. The camouflage net as claimed in claim 15, wherein the knitted fabric (1) has first and second sides and is provided with a polymer layer on both of the first and second sides.

20. The camouflage net as claimed in claim 15, wherein the holes (4) of the hole structure (3) are arranged in row form in the knitted fabric (1), and the holes (4) are arranged so as to be offset to one another in successive stitch rows.

* * * * *